United States Patent [19]

Petzelt

[11] Patent Number: 4,838,424

[45] Date of Patent: Jun. 13, 1989

[54] CARTON STRUCTURE FOR FORMING LINED CARTON WITH INTERIOR INSERT

[75] Inventor: George D. Petzelt, Montgomery, Ohio

[73] Assignee: American Packaging Corporation, Philadelphia, Pa.

[21] Appl. No.: 105,918

[22] Filed: Oct. 8, 1987

[51] Int. Cl.[4] ..... B65D 5/42

[52] U.S. Cl. ..... 206/459; 206/620; 206/628; 206/831; 220/416; 220/462

[58] Field of Search ..... 206/611, 620, 628, 459, 206/831; 40/312; 220/416, 418, 462

[56] References Cited

U.S. PATENT DOCUMENTS

| | | | |
|---|---|---|---|
| 2,099,257 | 11/1937 | Bergstein | 220/418 |
| 3,083,889 | 4/1963 | Christensson | 220/462 |
| 3,207,411 | 9/1965 | Forquhar | 206/459 |
| 3,219,253 | 11/1965 | Davis | 206/831 |
| 3,220,634 | 11/1965 | Rubinstein | 206/459 |
| 3,311,281 | 3/1967 | Eisman | 206/831 |
| 3,561,667 | 2/1971 | Saltman | 220/462 |
| 3,695,422 | 10/1972 | Tripodi | 206/831 |
| 4,103,820 | 8/1978 | Mathison et al. | 206/831 |
| 4,318,235 | 3/1982 | Augeri | 206/831 |
| 4,345,393 | 8/1982 | Price et al. | 206/831 |
| 4,620,664 | 11/1986 | Kautman et al. | 206/831 |

*Primary Examiner*—Stephen Marcus
*Assistant Examiner*—Gary E. Elkins
*Attorney, Agent, or Firm*—Frank A. Follmer

[57] ABSTRACT

A carton structure for use in forming a lined carton wherein an insert is retained and positioned between the carton blank and the liner so as to permit removal thereof without opening the liner.

11 Claims, 5 Drawing Sheets

CARTON STRUCTURE FOR FORMING LINED CARTON WITH INTERIOR INSERT

BACKGROUND OF THE INVENTION

1. Field of the Invention

This invention relates generally to the field of cartons of the paperboard or boxboard type. More particularly, the invention relates to carton structures for forming a lined carton.

In many cartons of the indicated type it is required that the carton be accompanied with a brochure or sheet of instructions or the like or an envelope or packet containing additional material, which are hereinafter referred to as an "insert". For example, in cartons containing various chemicals, such as fungicides, the insert provides printed information regarding the nature of the sealed carton, its uses, and its possible harmful affects if not used according to directions.

2. Description of the Prior Art

In the past, the inserts of the indicated-type are placed on the outside of the carton by means of an adhesive strip. However, there are several problems with this prior art arrangement. For example, the insert may be knocked off or damaged during shipping or other handling procedures. Also, this arrangement is expensive to manufacture.

Another arrangement that might be used is to place the insert with the contents inside the liner. However, this is unsatisfactory since it is necessary to open the top of the carton and the liner in order to obtain access to the insert. The user would not have access to the insert and the information provided thereby until after the liner was opened, which may not be satisfactory. This arrangement has the further disadvantage that sometimes the insert is covered completely by the ingredients of the carton and is difficult to find. Moreover, thers is no way of determining if the carton does actually contain the essential insert without opening the carton and the liner.

Patents relating to cartons of the indicated type are U.S. Pat. Nos. 4,099,665 and 4,236,368, which disclose carton constructions and methods of making the same for cartons of the type disclosed herein. Also, reference is made to U.S. Pat. No. 3,342,402 which discloses a bag of the automatic or self-opening type wherein an insert is positioned within the bottom folds of the bottom construction of the bag.

SUMMARY OF THE INVENTION

It is the general object of the invention to provide a carton structure for use in forming a lined carton wherein an insert is retained in position between the carton blank and the liner so as to permit removal thereof without opening the liner.

Briefly stated, the carton structure in accordance with the invention comprises a blank adapted to be formed into a flattened tubular condition and including a pair of opposing sidewalls and a pair of opposing endwalls, a tubular liner adhered to the inner surface of the blank and extending in opposed relation thereto throughout its extent, top closure flaps formed at the upper end of the blank, bottom closure flaps formed at the lower end of the blank, and an insert positioned between the inner surface of one of said sidwalls of the blank and opposing portion of the liner, the insert being retained in its position between the blank and the liner while permitting removal thereof without opening the liner.

Another object of the invention is to provide a novel method of making the above-described carton structure in accordance with the invention The carton structure in accordance with the invention overcomes the problems of the prior art since it positions the insert at a location which protects it from damage and ensures that it will not be knocked off during shipping and handling. Also, the insert is readily accessible to the user without having to open the liner. Further, the carton structure is such that it can be easily and inexpensively manufactured by t he present-day carton making equipment.

DESCRIPTION OF THE PREFERRED EMBODIMENTS

Figure 1:
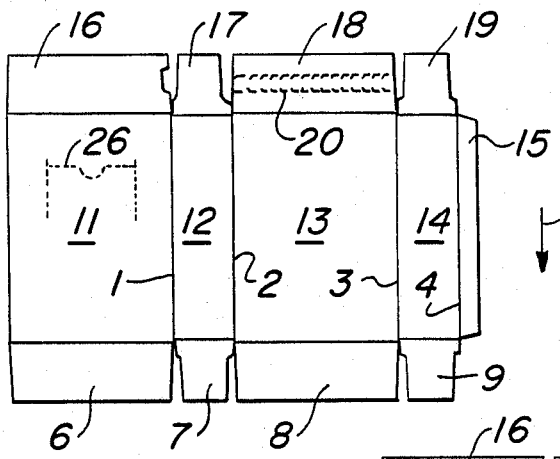
FIG. 1 is a plan view of a carton blank for use in making the carton structure in accordance with the invention.

Referring to FIG. 1 of the drawings, the carton blank shown comprises a sheet of suitable paperboard or boxboard cut and scored as shown in this figure. The blank is provided with four scores 1, 2, 3 and 4 to define a sidewall 10, an endwall 12, a sidewall 13 and an endwall 14, respectively, with an attachment flap 15 hingedly connected to the outermost side edge of endwall 14. The walls or panels 11, 12, 13 and 14 have attached thereto conventional end closure flaps 6, 7, 8 and 9, respectively, at one end thereof, the flaps 6, 7, 8 and 9 forming the bottom end closure flaps of a conventional carton bottom as will be described hereafter. The body walls 11, 12, 13 and 14 are also provided with conventional end closure flaps 16, 17, 18 and 19, respectively, at their other ends, said closure flaps 16–19 being of conventional construction and arranged to form the top closure of the carton as will be described hereafter. Top end closure flap 18 is provided with a conventional tear strip 20 for use in opening the carton as will be described nmore fully hereafter.

Figure 2:
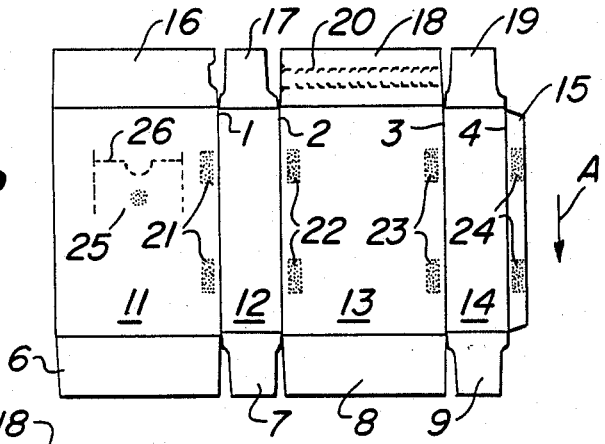
FIG. 2 is a plan view similar to FIG. 1 illustrating the carton blank in a subsequent step in the method of forming the carton structure.

With the blank in the condition shown in FIG. 1, it may be readily fabricated into a knock-down tubular condition by advancing it in the direction of the arrow A shown in this figure. Utilizing conventional carton folding and gluing equipment the carton blank is fed out of a hopper by timed feed pads into a register section which carries the carton blank into a prebreak section. The carton blank is then fed into a prebreak section. illustrated in FIG. 2, where the glue is applied to the carton blank by timed glue pads. At this register section, dots and strips of adhesive are applied to the upper surfaces of the sidewalls 11 and 13 and flap 15, which surfaces face inwardly when the carton is formed. As is apparent from FIG. 2, the glue is applied along spaced apart pairs of short strips 21, 22, 23 and 24 at the locations shown adjacent the scores 1–4 and spaced apart along the length of the blank. In addition, a small circular spot of adhesive 25 is applied in the center of sidewall 11 in the area of the thumb notch curout 26 as is apparent from this figure.

Figure 3:
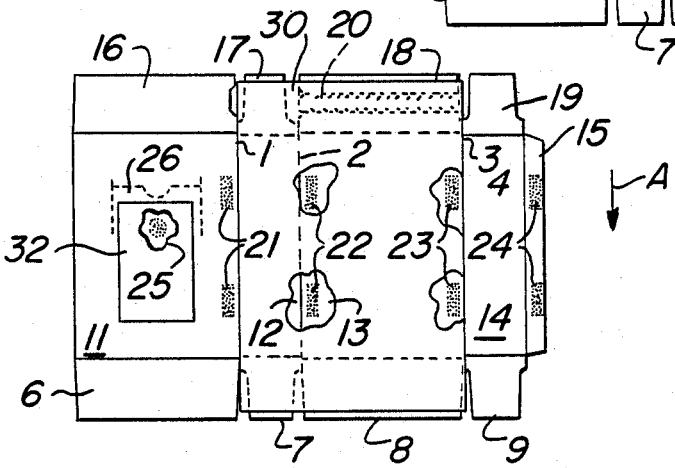
FIG. 3 is a plan view of the carton blank shown in FIG. 1 illustrating the positioning of a flat-folded tubular liner on the carton blank.

The carton blank then travels to a folding section, illustrated in FIG. 3, whereat a liner 30, which is made of a moisture/vapor-proof material and which has been formed, heat-sealed and cut off by a knife to form a flat-folded tube, meets the carton blank and is registered therein. Utilizing conventional equipment, the carton blank and liner 30 meet at a nip point prior to going into the folding section whereupon they are pulled through with a top and bottom center carrier just prior to folding. The tack of the adhesive along with the top and bottom center belt holds the liner 30 in position. Also, as the carton blank containing the liner 30 moves into the folding section and at a location prior to folding, an insert, in the form of a packet 32, is put on sidewall 11 so as to overlie the adhesive spot 25 thereon, as is shown in FIG. 3.

After the packet 32 and the liner 30 are applied as shown in FIG. 3, the carton blank then moves through the folding section where the carton blank is folded on scores 1 and 3. In this folding step, initially endwall 14 and the attachment flap 15 will be infolded together to overlie the adjoining side of the liner 30, which move is followed by the infolding of the sidewall 11 (along with packet 32 which adheres to sidewall 11 by reason of adhesive spot 25) on the opposite side of the carton bland thereby bringing the carton blank to the flat-folded condition illustrated in FIG. 4. It will be understood that in accordance with conventional practice, a strip of adhesive will be interposed between the outermost side edge of sidewall 11 and the surface of attachment flap 15 contacted thereby, such adhesive strip being indicated at 27 in FIG. 4.

Figure 4:
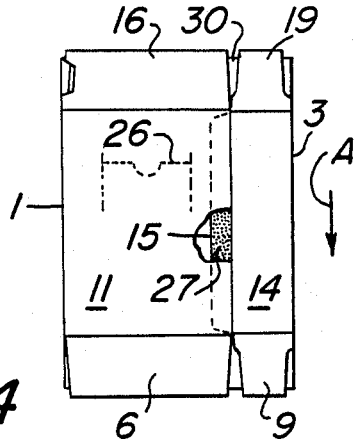
FIG. 4 is a plan view illustrating the carton blank in a flat-folded tubular condition.

After the carton blank is folded to the condition shown in FIG. 4, it is passed into a compression apron whereby pressure is applied to securel adhere the liner 30 to the carton blank and the packet 32 to the sidewall 11 at the inner surface thereof. Liner 30 adheres to the opposing surfaces of sidewalls 11 and 13 at the pairs of glue strips 21, 24 and 22, 24, respectively. Packet 32 adheres to sidewall 11 at glue spot 25.

It will be apparent that the flat-folded carton blanks as shown in FIG. 4 are in condition to be shipped and stored in a flattened condition as shown in this figure. In the hands of the packager, the carton blanks can be readily erected by simply "squaring up" the carton body walls, the carton walls being moved to prositions in which the adjacent walls lie at right angles to each other, such movement serving to automatically erect the tubular liner 30.

Figure 5:
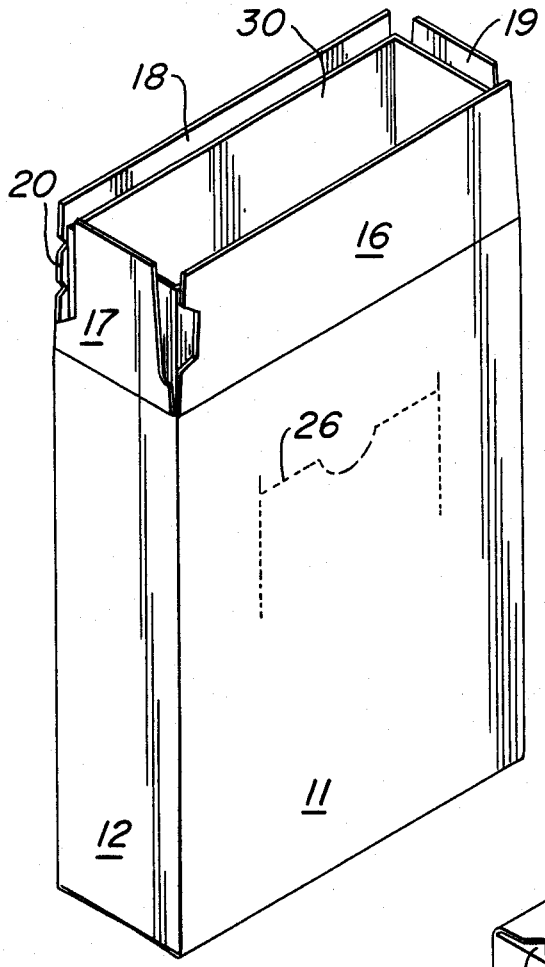
FIG. 5 is a perspective view illustrating the carton in an initially erected condition.
Figure 6:
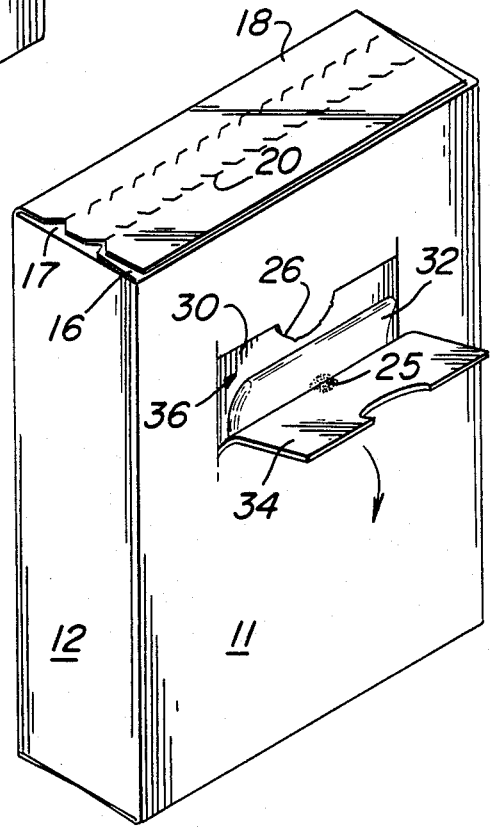
FIG. 6 is a perspective view showing a completed carton in accordance with the invention and illustrating the manner in which access is provided for the insert contained therein.

In the formation of a carton by the packager, the bottom end of the carton will be sealed first. In this procedure, the carton is inverted and the bottom end of the liner 30 flattened and sealed in conventional fashion, followed by the infolding of the liner 30 and the concurrent infolfing and sealing to gether of bottom closure flaps 6–9 as will be readily understood by those skilled in the art. Various types of folding and gluing apparatus are available to perform the necessary liner sealing, flat-folding and gluing operations. Following formation of the bottom end closure, the cartons will be inverted to a position as shown in FIG. 5 and filled with the desired contents, whereupon the uprighted and filled cartons, will be advanced for the formation of the top closure. The top closure is effected in conventional manner in the same manner as the bottom closure to form a carton closed at the top as illustrated in FIG. 6.

When the user of a carton desires to obtain access to the contents thereof and dispense the same, the user can initially obtain access to the packet 32 without opening the liner by manually pulling out the thumb notch 26 to form a flap 34 to expose the upper end of the packet 32 through a window pr access opening 36. The packet 32 can then be manually removed from the carton through the access opening 36 formed in the sidewall 11 by grasping the upper end of the packet 32 and pulling the same with sufficient force to overcome the small adhering force provided by the adhesive spot 25 holding the packet 32 to the inner surface of sidewall 11 as described above. Thus, the packet 32 is removed without opening the liner or damaging the carton structure and the user can then review the contents of the removed packet 32 to obtain proper instructions for the use and applicability of the contents of the carton.

Figure 7:
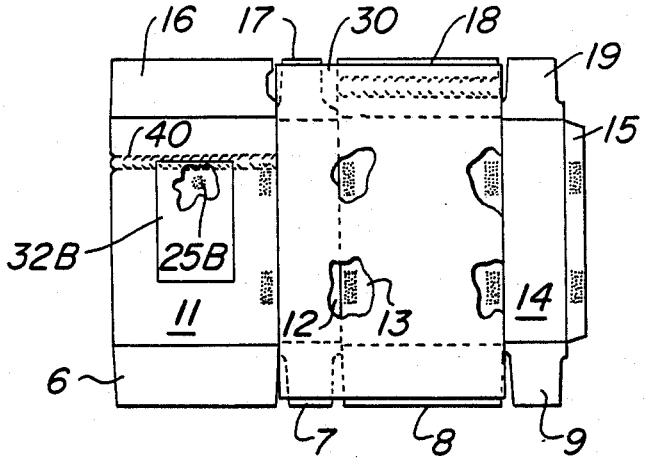
FIG. 7 is a plan view of a carton structure in accordance with a second embodiment of the invention.
Figure 8:
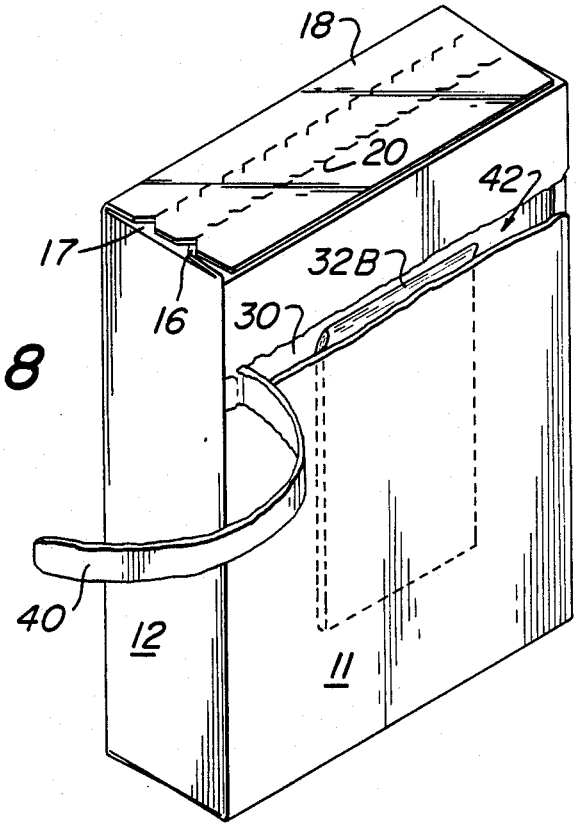
FIG. 8 is a perspective view showing a carton formed from the carton structure shown in FIG. 7 and illustrating the manner in which access is provided to the insert contained therein.

The second embodiment of the invention shown in FIGS. 7 and 8 is very similar to that shown in FIGS. 1–6 wherefore corresponding parts have been given the same reference numerals. The embodiment of FIGS. 7 and 8 comprises a different structure for providing access to the insert, i.e., a packet 32B. The carton of this second embodiment is made in essentially the same manner as that of the FIG. 1–6 embodiment and FIG. 7 shows the carton blank in the same condition as shown in FIG. 3. FIG. 7 also showns that sidewall 11 is provided with a small circular spot of adhesive 25B located in the center of sidewall 11 adjacent to a tear strip 40 formed therein. The tear strip 40 extends transversely across sidewall 11 at a lecation spaced a short distance below the top end closure flap 16. The packet 32B is placed on sidewall 11 during the formation of the carton blank so as to overlie the adhesive spot 25B and so that its top edge is aligned with tear strip 40 as is apparent from a consideration of FIGS. 7 and 8.

The carton blank as shown in FIG. 7 is formed into a completed carton, as shown in FIG. 8, in the same manner as described above with respect to the carton blank shown in FIGS. 1–4.

When the user of the carton shown in FIG. 8 desires to obtain access to the contents thereof and dispense the same, the user can initially obtain access to the packet 32B by manually pulling out the tear strip 40 to a position as shown in FIG. 8 to expose the upper end of packet 32 through a slot-shaped access opening 42 formed in sidewall 11. The packet 32B can then be manually removed from the carton through the access opening 42 formed in sidewall 11 by grasping the upper end of packet 32B and pulling the same with sufficient force to overcome the small adhering force of the adhesive spot 25B. The packet 32B is thus removed without opening the liner or providing any serious damage to the carton structure and the user can review the contents of the packet 32B to obtain proper instructions for the use and applicability of the contents of the carton.

Figure 9:
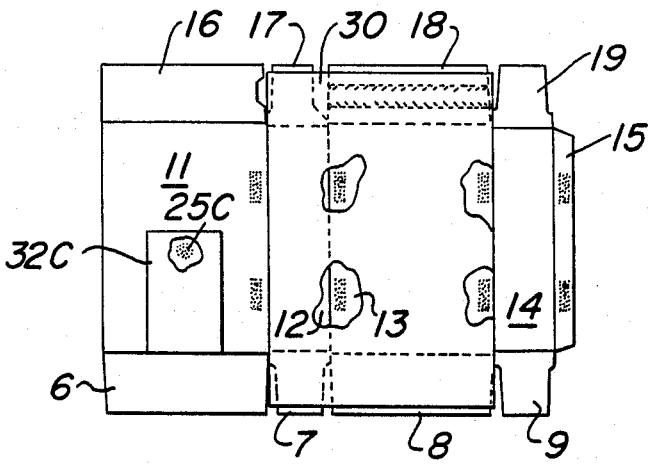
FIG. 9 is a plan view of a carton blank in accordance with a third embodiment of the invention.
Figure 10:
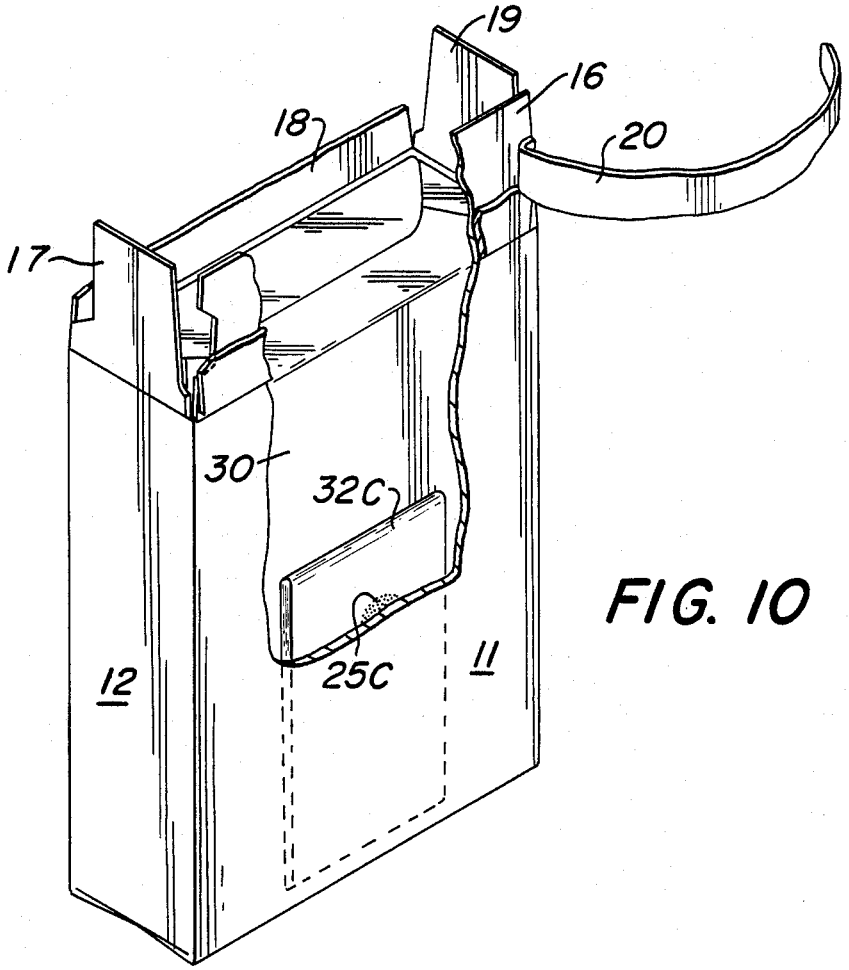
FIG. 10 is a perspective view of a carton formed from the carton structure shown in FIG. 9 and illustrating the manner in which access is provided to the insert contained therein.

The third embodiment of the invention shown in FIGS. 9 and 10 is very similar to that shown in FIGS. 1–6 wherefore corresponding parts have been given the same reference numerals. The embodiment of FIGS. 9 and 10 comprises a different structure for providing access to the linsert, i.e., a packet 32C. FIG. 9 shows the carton blank in the same condition as shown in FIG. 3 and shows that the sidewall 11 is provided with a small circular spot 25C located in the center of sidewall 11 and closer to the bottom end closure flap 6 than circular spot 25. As is shown in FIG. 9, the third embodiment of the invention is not provided with any thumb notch or tear strip to provide access to the packet 32B through an access opening in the sidewall 11. Also, it is noted that the packet 32C is put on sidewall 11 so as to overlie the adhesive spot 25C and so that its bottom edge is near the bottom of sidewall 11. The carton blank as shown in FIG. 9 is formed into a completed carton as shown in FIG. 10, in the same manner as the carton bland shown in FIGS. 1–4.

When the user of the carton desires to obtain access to the contents thereof and dispense the same, the user can initially obtain access to the packet 32C by manually pulling out the tear strip 20 on the top flap 18 to the point where the two top flaps 16 and 18 are separated and then opening the top of the carton to the position as shown in FIG. 10. The packet 32C can then be manually removed from the carton through the open top thereof by the user extending his hand down between the sidewall 11 and the liner 30 and grasping the upper end of the packet 32C and pulling the same with sufficient force to overcome the small adhering force of the adhesive spot 25C and thereby separating the packet 32C from the sidewall 11 and removing it from the carton through the top open end thereof.

Figure 11:
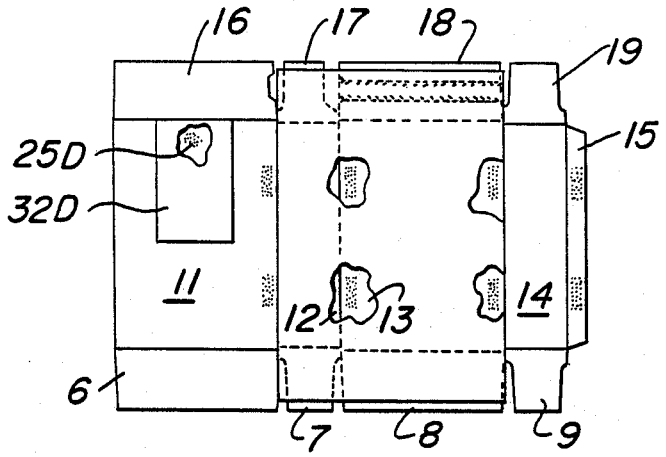
FIG. 11 is a plan view of a carton blank in accordance with a fourth embodiment of the invention.
Figure 12:
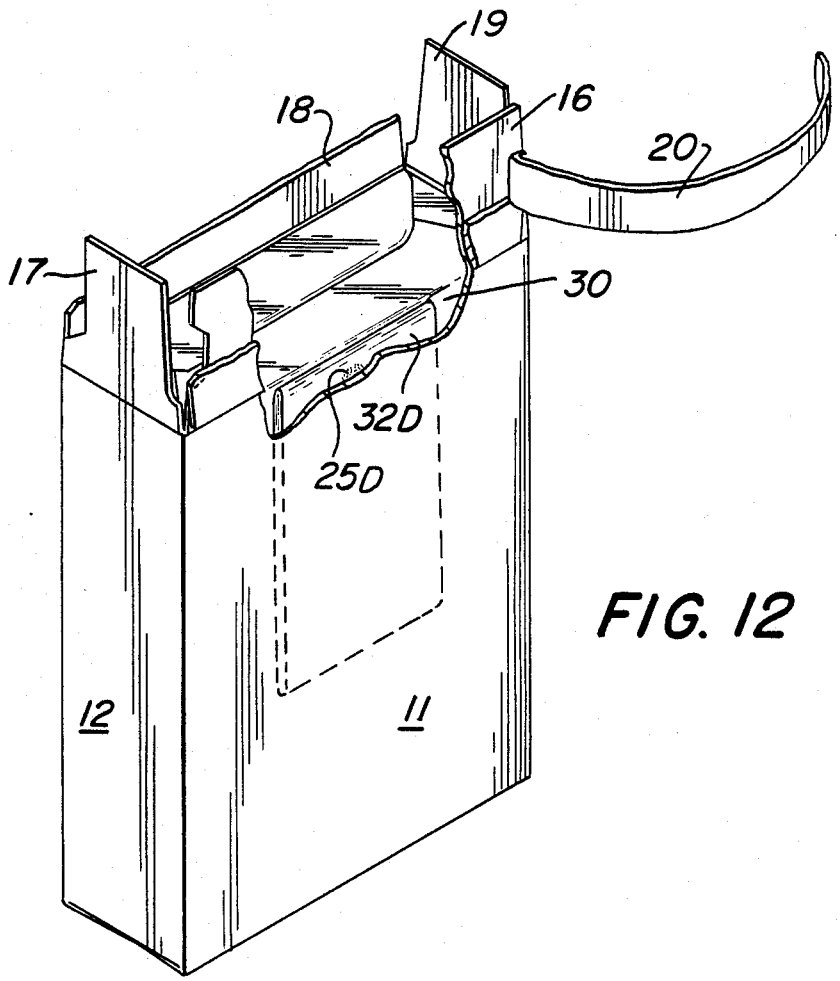
FIG. 12 is a perspective view of a carton formed from the carton structure shown in FIG. 11 and illustrating the manner in which access is provided to the insert contained therein.

The fourth embodiment of the invention shown in FIGS. 11 and 12 is essentially identical to that shown in FIGS. 9 and 10 and the construction and use thereof is the same as that described above. The only difference between the embodiment of FIGS. 11 and 12 and that of FIGS. 9 and 10 is the position whereat the packet 32D is adhered to the sidewaal 11. As is shown in FIGS. 11 and 12 the sidewall 11 is provided with a small circular spot of adhesive 25D in the center thereof and located near the upper end of the carton, i.e., near top closure flap 16. The user can obtain access to the packet 32D of the embodiment of FIGS. 11 and 12 in the same manner as described above with respect to the embodiment of FIGS. 9 and 10 by opening the top end of the carton and then inserting his hand through the open end to graps the top end of the packet 32D and remove it from the carton as described above. The positioning of the packet 32 at the upper end of the carton as shown in FIGS. 11 and 12 provide somewhat easier access to the packet as compared to the embodiment of FIGS. 9 and 10.

The characteristics and advantages of the invention have been set forth in the foregoing description, together with the details of the structure and method of the invention, and the novel features thereof are set forth in the appended claims. The disclosure, however, is illustrative only, and changes may be made in the details thereof, especially of matters of shape, size and arrangement of parts, within the principle of the invention to the full extent extended by the broad general meaning of the terms in which the appended claims are expressed.

WHAT IS CLAIMED IS:

1. A flat container structure in knocked-down form adapted to be squared-up for forming a lined carton comprising:

a blank having an upper end and a lower end and including a pair of opposing sidewalls and a pair of opposing endwalls, said blank being formed into a flattened tubular condition to provide an inner surface including inner surface portions of said sidewalls and said endwalls, a tubular liner adhered to said inner surface of said blank and extending in opposed relation thereto throughout its extent, top closure flaps formed at said upper end of said blank, bottom closure flaps formed at said lower end of said blank, an insert positioned within the interior of said flattened tubular blank between said inner surface portion of one of said sidewalls and the opposing portion of said liner, and means for retaining said insert in said position between the blank and the liner while permitting manual removal thereof without opening said liner, said one sidewall being provided with a thumb notch adapted to form an access opening in said one sidewall.

2. A carton structure according to claim 1 wherein said means retaining said insert comprises adhesive means securing a small portion of said insert to a portion of said one sidewall of said blank.

3. A carton structure according to claim 2 wherein said insert is located on said one sidewall at a generally medial location.

4. A container structure according to claim 2 wherein said adhesive means comprises a small glue spot providing a small adhering force which can be easily overcome during the removal of the insert from its adhered position.

5. A container structure according to claim 1 wherein said insert is positioned to be contained entirely adjacent said one sidewall and between said top and bottom closure flaps.

6. A container structure according to claim 1 wherein said liner is adhered to the interior surface of said blank by pairs of spaced-aparft strips of glue spaced apart along the length of the interior of said blank.

7. A flat container structure in knocked-down form adapted to be squared-up for forming a lined carton comprising:

a blank having an upper end and a lower end and including a pair of opposing sidewalls and a pair of opposing endwalls, said blank being formed into a flattened tubular condition to provide an inner surface including inner surface portions of said sidewalls and said endwalls, a tubular liner adhered to said inner surface of said blank and extending in opposed relation thereto throughout its extent, top closure flaps formed at said upper end of said blank, bottom closure flaps formed at said lower end of said blank, an insert positioned between said inner surface portion of one of said sidewalls and the opposing portion of said liner, and means for retaining said insert in said position between the blank and the liner while permitting manual removal thereof without opening said liner, said means retaining said insert comprising adhesive means securing a small portion of said insert to a portion of said one sidewall of said blank, said one sidewall being provided with a thumb notch adapted to form an access opening in said one sidewall.

8. A container structure according to claim 7 wherein said insert is secured to said one sidewall by said adhesive means at a location wherein an end of said insert is contained within said access opening.

9. A flat container structure in knocked-down form adapted to be squared-up for forming a lined carton comprising:

a blank having an upper end and a lower end and including a pair of opposing sidewalls and a pair of opposing endwalls, said blank being formed into a flattened tubular condition to provide an inner surface including inner surface portions of said sidewalls and said endwalls, a tubular liner adhered to said inner surface of said blank and extending in opposed relation thereto throughout its extent, top closure flaps formed at said upper end of said blank, bottom closure flaps formed at said lower end of said blank, an insert positioned between said inner surface portion of one of said sidewalls and the opposing portion of said liner, and means for retaining said insert in said position between the blank and the liner while permitting manual removal thereof without opening said liner, said means retaining said insert comprising adhesive means securing a small portion of said insert to a portion of said one sidewall of said blank, said one sidewall being provided with a tear strip, said tear strip being adapted to form a slot-like access opening in said one sidewall to provide access to said insert.

10. A container structure according to claim 9 wherein said insert is secured to said one sidewall at a location so that one end thereof is aligned with the access opening formed by said tear strip.

11. A flat container structure in knocked-down form adapted to be squared-up for forming a lined carton comprising:

a blank having an upper end and a lower end and including a pair of opposing sidewalls and a pair of opposing endwalls, said blank being formed into a flattened tubular condition to provide an inner surface including inner surface portions of said sidewalls and said endwalls, a tubular liner adhered to said inner surface of said blank and extending in opposed relation thereto throughout its extent, top closure flaps formed at said upper end of said blank, bottom closure flaps formed at said lower end of said blank, an insert positioned within the interior of said flattened tubular blank between said inner surface portion of one of said sidewalls and the opposing portion of said liner, and means for retaining said insert in said position between the blank and the liner while permitting manual removal thereof without opening said liner, said one sidewall being provided with a tear strip, said tear strip being adapted to form a slot-like access opening in said one sidewall to provide access to said insert.

* * * * *